United States Patent [19]

Portugali

[11] 4,000,959

[45] Jan. 4, 1977

[54] FREE-PISTON ROTARY DEVICE PARTICULARLY USEFUL AS HYDRAULIC MOTOR OR PUMP

[76] Inventor: Iza Portugali, 14 Givati St., Apt. 17, Afridar, Ashkelon, Israel

[22] Filed: Mar. 17, 1975

[21] Appl. No.: 559,239

[52] U.S. Cl. ..... 418/35

[51] Int. Cl.[2] ..... F01C 1/00; F03C 3/00; F04C 1/00

[58] Field of Search ..... 418/33, 223, 35, 36; 123/8, 47

[56] References Cited

UNITED STATES PATENTS

| | | | |
|---|---|---|---|
| 830,124 | 9/1906 | Weeks | 418/35 |
| 2,367,676 | 1/1945 | Griffith | 418/36 |
| 3,304,921 | 2/1967 | Prochazka et al. | 418/36 |

FOREIGN PATENTS OR APPLICATIONS

| | | | |
|---|---|---|---|
| 14,671 | 11/1911 | France | 123/8.47 |
| 319,531 | 7/1902 | France | 123/8.47 |
| 10,360 | 7/1880 | Germany | 418/35 |
| 12,895 | 3/1881 | Germany | 418/35 |
| 194,579 | 1/1908 | Germany | 123/8.47 |
| 316,820 | 4/1934 | Italy | 123/8.47 |
| 496,472 | 7/1954 | Italy | 123/8.47 |
| 9,549 | 6/1893 | United Kingdom | 418/36 |
| 6,419 | 11/1833 | United Kingdom | 418/35 |

*Primary Examiner*—John J. Vrablik
*Attorney, Agent, or Firm*—Benjamin J. Barish

[57] ABSTRACT

A free-piston bi-directional rotary device is described particularly useful as a compact, low-RPM, high-torque hydraulic motor, but which may also be useful for other applications such as rotary pumps, rotary engines, and the like. The rotary device comprises a stator, a rotor mounted coaxially for rotary movement with respect to the stator and spaced radially therefrom to define an annular gap therebetween, and a plurality of pistons movable within the annular gap in a circumferential direction. Each of the pistons is formed with a slot, and a coupling bar is disposed within the slot and is shiftable radially from a first position coupling the piston to the stator, to a second position coupling the piston to the rotor. The positioning means includes a hydraulic distributor which controls the flow of a pressurized fluid to the coupling bars in timed relationship to the rotation of the rotor, such that the bars are alternately coupled to the stator and to the rotor, to form alternating expansible and contractable chambers between successive pistons as the rotor rotates with respect to the stator.

8 Claims, 9 Drawing Figures

FIG. 1
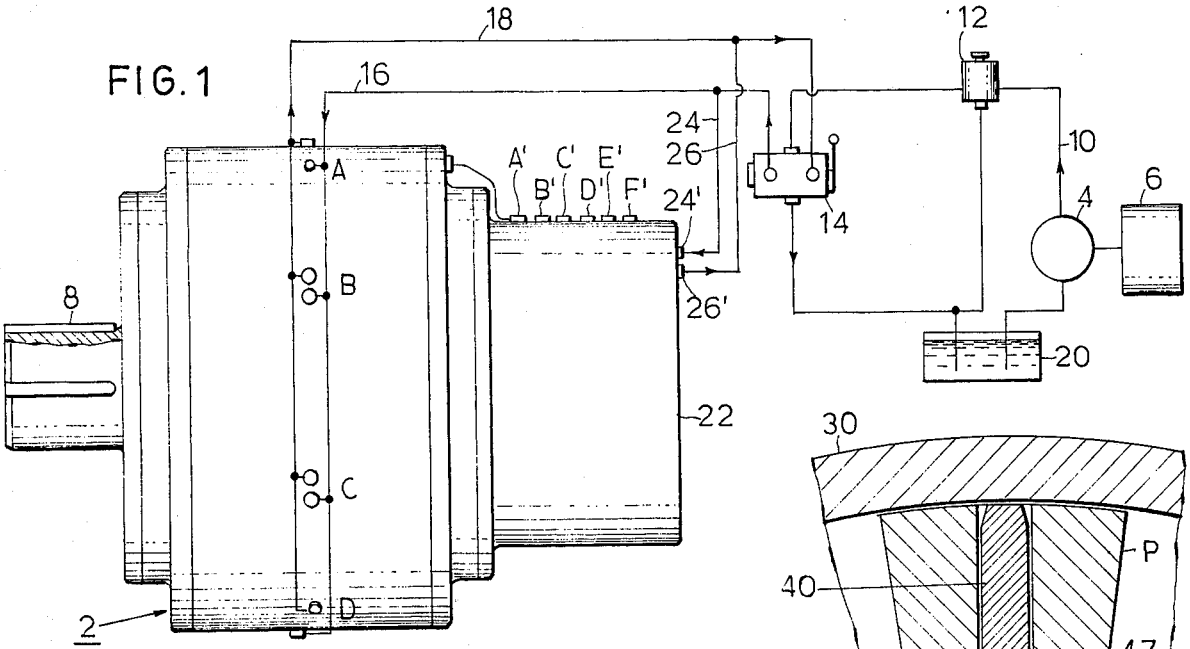
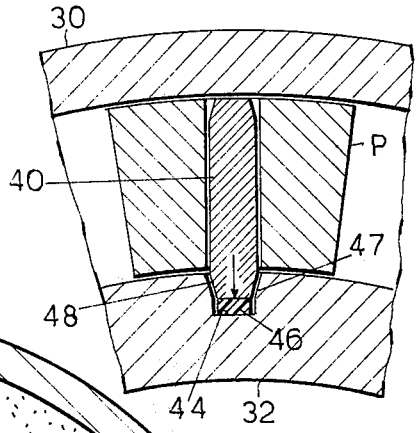
FIG. 2a
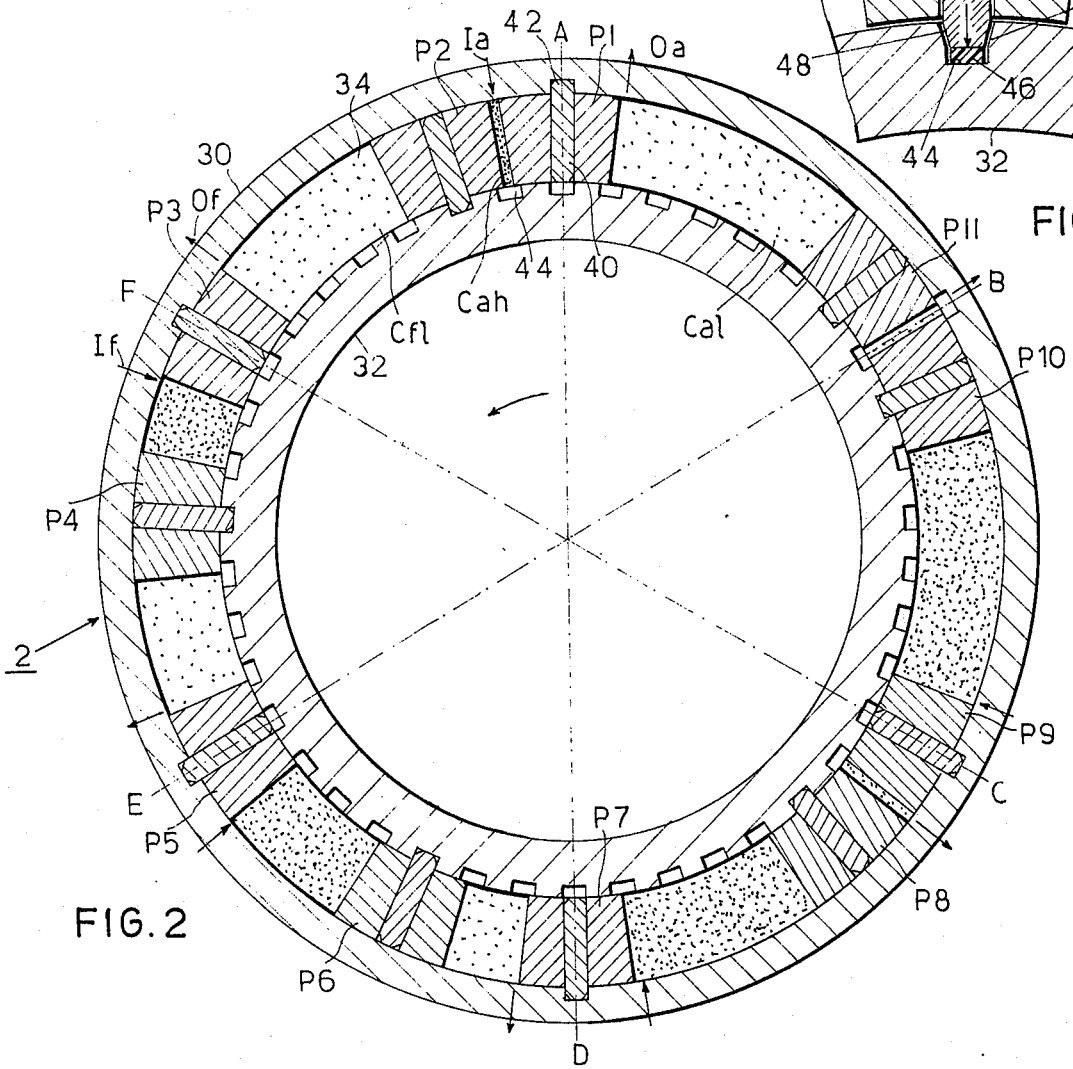
FIG. 2

FREE-PISTON ROTARY DEVICE PARTICULARLY USEFUL AS HYDRAULIC MOTOR OR PUMP

BACKGROUND OF THE INVENTION

The present invention relates to rotary devices of the free-piston type. The invention is particularly useful with respect to low-RPM, high-torque bi-directional hydraulic motors, and is therefore described with respect to that application, but it will be appreciated that features of the invention could be used in other applications as well, such as hydraulic pumps, rotary engines, and the like.

BRIEF SUMMARY OF THE INVENTION

According to the invention, there is provided a rotary device comprising a stator, a rotor mounted coaxially for rotary movement with respect to the stator and spaced radially therefrom to define an annular gap therebetween, and a plurality of pistons movable in a circumferential direction within the annular gap. Each of the pistons includes a coupling member movable from a first position coupling the piston to the stator, to a second position coupling the piston to the rotor. Positioning means are provided for selectively shifting the coupling members such that they are alternately coupled to the stator and to the rotor, to form alternating expansible and contractable chambers between successive pistons as the rotor rotates with respect to the stator.

In the preferred embodiment of the invention described below, the coupling members are in the form of bars and each is shiftable in a slot extending in a radial direction through its respective piston. Also in the preferred embodiment, the positioning means for selectively shifting the coupling bars comprises a source of pressurized fluid and a hydraulic distributor controlling the flow of the fluid to the coupling bars in synchronized timed relationship to the rotation of the rotor.

As indicated earlier, the preferred embodiment of the invention is a bi-directional hydraulic motor. In this embodiment, the rotary device includes a source of driving fluid, means for introducing the driving fluid into the chambers to cause them to expand and thereby to rotate the rotor, and means for removing the driving fluid from the chambers during the contraction thereof.

Another described application of the invention is a pump, in which the rotary device includes a drive for driving the rotor, means for introducing fluid to be pressurized into the chambers as they expand by the rotation of the rotor, and means for removing the resulting pressurized fluid from the chambers as they are contracted by the rotation of the rotor.

The invention, and particularly the arrangement for providing the alternating expansible and contractable chambers, could be used in other applications, e.g., in rotary combustion engines.

Further features and applications of the invention will be apparent from the description below.

BRIEF DESCRIPTION OF THE DRAWINGS

The invention is herein described, by way of example only, with reference to the accompanying drawings, wherein:

FIG. 1 is a diagram illustrating a hydraulic motor system constructed in accordance with the invention;

FIG. 2 is a transverse sectional view of the rotary device in the system of FIG. 1;

FIG. 2*a* is an enlarged fragmentary view of FIG. 2;

DESCRIPTION OF THE PREFERRED EMBODIMENTS

Figure 6:
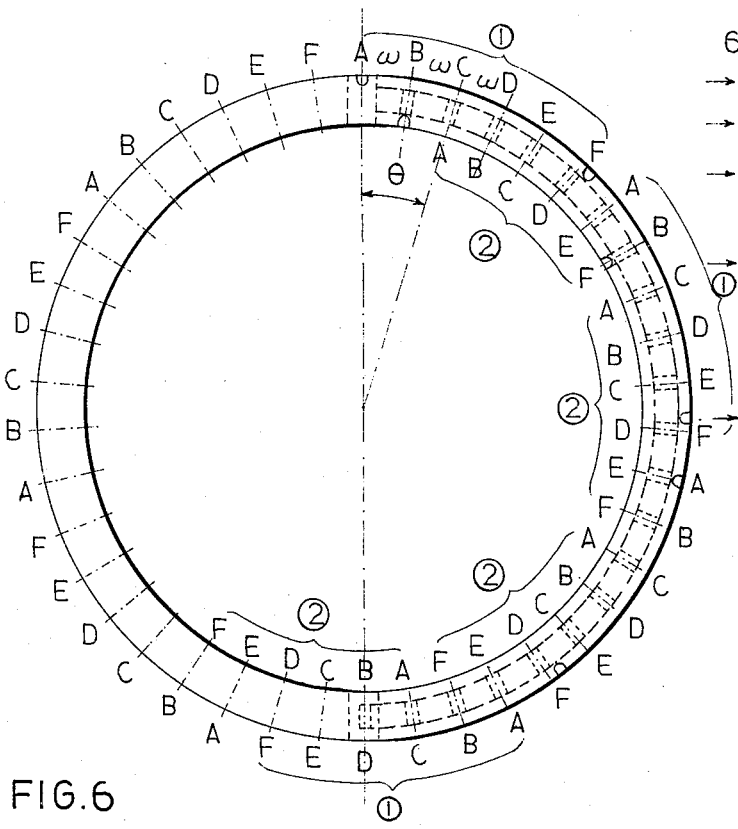
FIG. 6 is a diagram illustrating the hydraulic distributor for controlling the coupling bars.

FIG. 1 illustrates one application of the invention, namely a compact, low-RPM, high-torque, bi-directional hydraulic motor 2 supplied from a pump 4 driven by an electric motor 6, the hydraulic motor producing a mechanical output on its output shaft 8. The driving fluid (e.g., oil) is fed from pump 4 via line 10, pressure-release valve 12, and a four-way two-position valve 14, to the inlet line 16 of the hydraulic motor; and the spent fluid is returned from the hydraulic motor via outlet line 18 and valve 14 to the oil tank 20 which supplies pump 4. Hydraulic motor 2 further includes a distributor 22 supplied with pressurized control fluid (e.g., oil) via valve 14, inlet line 24, and outlet line 26.

Figure 3:
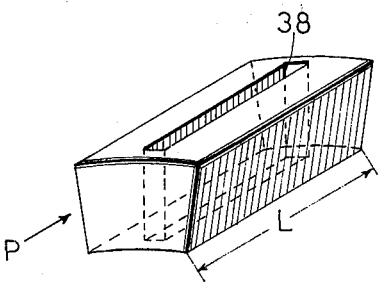
FIG. 3 is a perspective view illustrating one of the free pistons included in the rotary device of FIG. 1.

The internal structure of the hydraulic motor 2 is seen in FIGS. 2, 2*a* and 3. It includes an outer cylindrical stator 30 and an inner cylindrical rotor 32 of smaller diameter and mounted coaxially for rotary movement with respect to the stator, the radial space between the stator and rotor defining an annular gap 34. A plurality of pistons P, one of which is shown in FIG. 3, are disposed within gap 34 and are movable therein in a circumferential direction. In the illustrated embodiment there are eleven pistons, identified as P1-P11.

Each piston P is formed with a slot 38 (FIG. 3) extending completely therethrough. A coupling bar 40 (FIGS. 2, 2*a*) is disposed in each slot and is adapted to couple the respective piston either to the stator 30 or to the rotor 32. For this purpose, the inner cylindrical surface of the stator 30 is formed with a plurality of axially-extending recesses or notches 42 for receiving the outer ends of the respective coupling bars 40, and the outer cylindrical surface of rotor 32 is likewise formed with a number of recesses or notches 44 for receiving the inner ends of the respective coupling bars.

It will thus be seen that by controlling the position of the coupling bars 40, each piston P1–P11 can be coupled either to the stator 30 (in which case the piston would remain stationary), or to the rotor 32 (in which case the piston would rotate with the rotor). Positioning means are provided, as will be more particularly described below, for selectively positioning the coupling bars such that the pistons are alternately coupled to the stator 30 and to the rotor 32, to thereby form alternating expansible and contractable chambers within annular space 34 between successive pistons as the rotor rotates with respect to the stator.

While the example illustrated includes 11 pistons P1–P11, it will be appreciated that a smaller or larger number could be used. Assuming that the number of pistons is $n$, at any one instant $n+1/2$ (or 6 in the described example) would be coupled to the stator 30 and would therefore be stationary, and $n-1/2$ (or 5) would be coupled to the rotor and would therefore be rotating. Accordingly, there would be $n+1/2$ (or 6) recesses 42 in the stator for selectively receiving the outer ends of the coupling bars 40, each recess 42 defining a station, the stations being labelled (clockwise) as A–F. Also, there would be $n+1/2$ times $n+3/2$ (or 42) recesses 44 in the rotor 32 for selectively receiving the inner ends of the coupling bars 40.

Preferably, the coupling bars are spring-biassed into the stator recesses 42, this being schematically shown in FIG. 2*a* by a spring 46, e.g., a resilient rubber pad, within each rotor recess 44 pressing against the inner end of the coupling bar 40. The coupling bars are selectively actuated to seat within the rotor recesses 44 by means of a hydraulic control system supplied via lines 24, 26 of FIG. 1, as will be described more fully below. The sides of the recesses and coupling bar ends are bevelled, as shown at 47 and 48, respectively, to facilitate the smooth entry and withdrawal of the bars with respect to the recesses of both the rotor and stator.

The hydraulic motor 2 includes an oil inlet and an oil outlet for each of the six stations A–F defined by the six stator recesses 42. Assuming in FIG. 2 that the rotor rotates counter-clockwise (the direction of rotation being controlled by the two-position valve 14 connected to lines 24, 26 of the hydraulic control system as to be described more fully below), the chamber on the counter-clockwise side of each stationary piston (i.e., the piston seated at that instant in a stator recess 42) would be a high-pressure chamber, receiving the high-pressure fluid via line 16; and the chamber on the opposite (or clockwise) side of each stationary piston would be a low-pressure chamber from which the spent or low-pressure driving fluid flows into the outlet line 18.

Thus, with respect to piston P1 coupled in station A to the stator 30 (FIG. 2), it will be seen that chamber *Cah* at that instant is a high-pressure chamber and is supplied with the high-pressure oil via its inlet I*a*, whereas chamber *Cal* on the other side of the piston P1 is a low-pressure chamber from which the spent oil is drained via outlet 0*a*.

The high-pressure oil within chamber *Cah* drives piston P2 counter-clockwise, since piston P1 defining the other end of the chamber is stationary at that instant. As piston P2 is driven by the high-pressure oil, it drives with it rotor 32 to which the coupling bar 40 of piston P2 is coupled, causing the oil within low-pressure chamber C*f*1 on the other side of the moving piston P2 to drain through outlet 0*f*. The draining of the oil in the low-pressure chamber *Cal* via its outlet 0*a* on the other side of piston P1 fixed in station A, is effected by piston P11, the latter piston being coupled at that instant to rotor 32 moving towards the fixed piston P1.

All the driving fluid inlets (I*a*–I*f*, FIG. 4) are connected in parallel to the inlet line 16 (FIG. 1) so as to continuously receive high-pressure driving fluid; and all the driving fluid outlets (0*a*–0*f*) are connected in parallel to the outlet line 18 for the driving fluid so as to permit the continuous drain of the spent fluid from the hydraulic motor. Hydraulic distributor 22 (FIG. 1) is rotated by rotor 32 of the hydraulic motor, this distributor including a stationary member fixed to the motor stator 30 and having a plurality of passageways leading to different locations of the stator at which the coupling bars 40 are coupleable, and a rotary member driven by the motor rotor 32 to control the flow of fluid from the pressurized fluid source to the passageways for controlling the actuation of the coupling bars 40 in timed sequence synchronized with the rotation of the rotor, to effect the rotation of the rotor.

Figure 7:
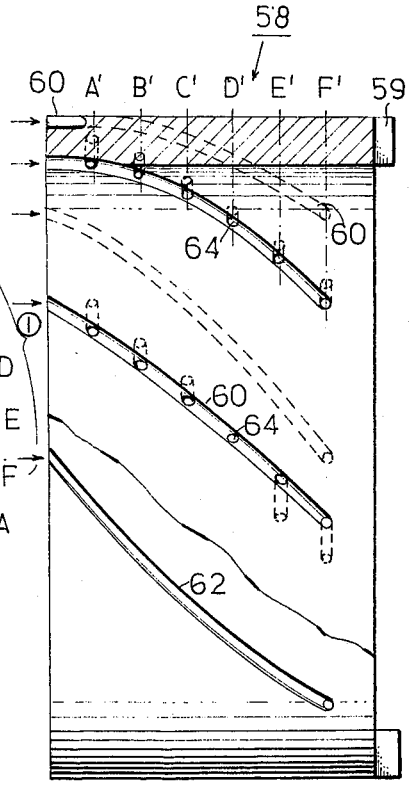
FIG. 7 is an elevational view, partly in section, illustrating the intermediate ring in the hydraulic distributor of FIG. 5.
Figure 5:
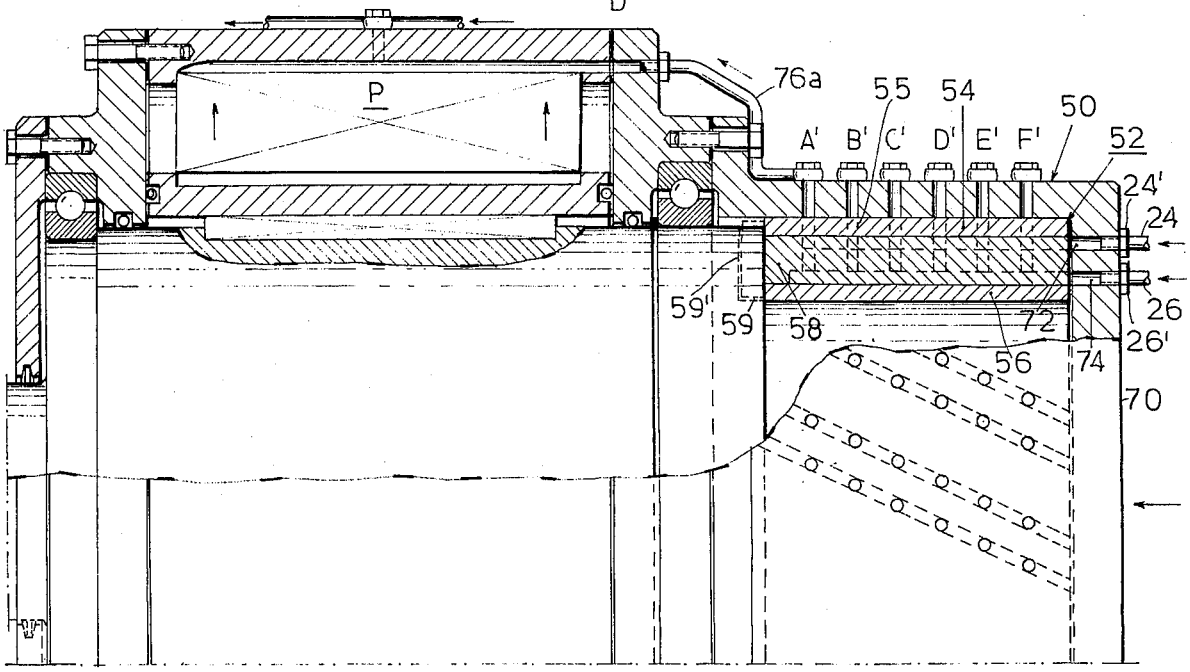
FIG. 5 is a partial longitudinal sectional view of the rotary device of FIG. 1, particularly illustrating the hydraulic distributor controlling the coupling bars in timed sequence synchronized with the rotation of the rotor.

The structure and mode of operation of hydraulic distributor 22 will be better understood by reference to FIGS. 5–7.

As shown in FIG. 5, distributor 22 includes a stationary housing 50 and a rotor 52 rotatably mounted within the housing. The distributor rotor is made up of three rings, namely an outer ring 54 formed with a plurality of openings 55, a smooth inner ring 56, and an intermediate ring 58, all three rings being fixed together to rotate as a unit. The rings are rotated by means of teeth 59 formed on one end face of the intermediate ring 58 (FIG. 7), which teeth are seated within recesses 59' (FIG. 5) formed in the corresponding end of the hydraulic motor 2.

The structure of intermediate ring 58 is best seen in FIGS. 6 and 7. Its inner face is formed with a plurality of oil channels 60, and its outer face is formed with another plurality of oil channels 62. There are seven groups of such channels on each face of the ring around its complete circumference, with each group including six channels, one for each of the stations A–F of the rotary device. Channels 60 and 62 extend axially of the ring and are curved circumferentially, the inner-face channels 60 being non-aligned with the outer face channels 62. The intermediate ring 58 is further formed with a plurality of holes 64 extending radially through the ring, leading from an inner face channel 60 to an ungrooved portion of the outer face of the ring.

Figure 4:
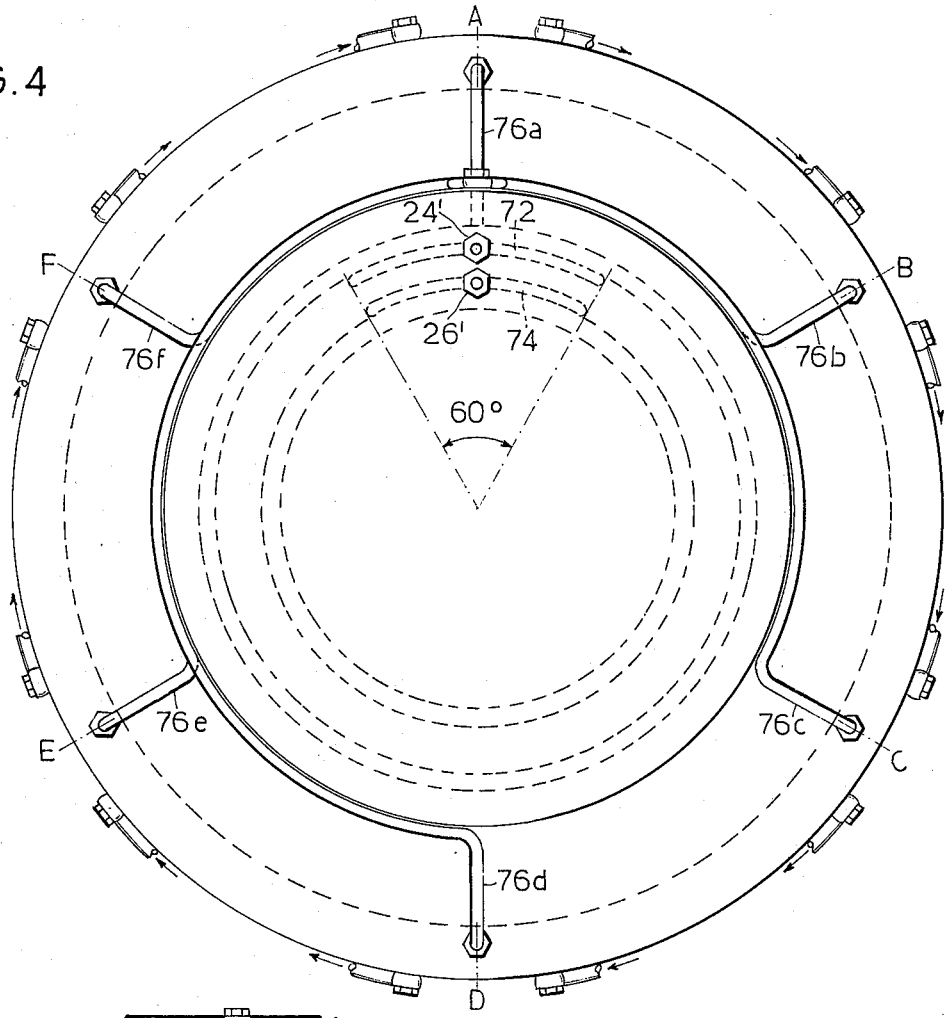
FIG. 4 is an end view of the hydraulic distributor used in the rotary device of FIG. 1.

The supply pipe 24 and the return pipe 26 for the control fluid are fixed in ports 24', 26' (FIGS. 4 and 5, respectively, formed in end plate 70 of the distributor housing 50. The inside face of end plate 70 is formed with a pair of grooves 72 and 74 (FIGS. 4 and 5) the two grooves extending for an arc of 60°. Port 24' for the drive fluid communicates with groove 72, and the latter groove is aligned with the oil channels 62 formed on the outer face of the intermediate ring 58. The return line port 26' communicates with groove 74, and that groove is aligned with the oil channels 60 formed on the inner face of the intermediate ring 58.

Distributor housing 50 is formed with six further ports, namely ports A'–F' (FIG. 5), there being one for and leading to each of the stations A–F of the rotary device via pipes 76*a*–76*f* (FIGS. 4 and 5). The holes 55 in the outer ring 54, and the holes 64 connecting the innerface channels 60 with the outer face of the intermediate ring 58 are spaced axially of the ring so as to be aligned with each other and alignable with ports A'–F' one at a time.

The arrangement is such that supply line 24 is always connected via slot 72 to at least one of the channels 62 formed on the outer face of the intermediate ring 58, and the return line 26 is always connected via slot 74 to at least one of the channels 60 formed on the inner face of the intermediate ring. Thus, as the distributor rotor 52 rotates, the ports A'–F' receive impulses of high-pressure control fluid from supply line 24 via the outer face channels 62 in a sequential manner, every 8.57 (approx.) degrees of revolution (360°/6×7). These impulses are transmitted via pipes 76*a*–76*f* to the stations A–F of the hydraulic motor 2, and cause the coupling bar 40 in each station, when a high-pressure impulse is present, to move into a recess 44 of the rotor 32 thereby coupling the respective piston P to the rotor. The spent fluid is returned to the oil tank via the holes 64, the inner-face channels 60 in the intermediate ring 58, and the return line 26.

When a coupling bar 40 is moved by one of the foregoing impulses, it moves out of a stator recess 42 at the respective station A–F of the hydraulic motor 2, into a recess 44 of the rotor 32, thereby loading spring 46 within that recess. Accordingly, as the so-occupied piston moves with the rotor, the outer face of its coupling bar 40 is engaged by the inner face of stator 30, thereby retaining the coupling bar 40 within the rotor recess 44 until it arrives at the next stator recess 42, at which time spring 46 forces the coupling bar out of the rotor recess 44 and into the stator recess 42 at the next station.

The hydraulic motor 2 operates as described above when line 24 (FIG. 1) is used as the high-pressure line supplying the drive fluid to the distributor 22; in such a case, the hydraulic motor will be rotated in a counter-clockwise direction.

An important feature of the present invention is that the direction of the rotary device can be easily reversed, by merely reversing the direction of flow of the control fluid through lines 24, 26, by valve 14, so that if line 26 is used as a high-pressure supply line for the drive fluid, the high-pressure impulses will be supplied via slot 74, the channels 60 formed on the inner face of ring 58, and holes 64, to ports A′–F′, whereupon the rotor will be rotated in the opposite, or clockwise direction.

The following table illustrates the distribution of the hydraulic impulses by means of distributor 22 in the example described, and also the direction of rotation produced by such distribution.

TABLE

| | | STATIONS | | | | | | | | | | | |
|---|---|---|---|---|---|---|---|---|---|---|---|---|---|
| | | COUNTER-CLOCKWISE | | | | | | CLOCKWISE | | | | | |
| n | wn | A | B | C | D | E | F | A | B | C | D | E | F |
| 0 | 0 | + | | | | − | | − | | | | + | |
| 1 | 8.57 | | + | | | | | | − | | | | + |
| 2 | 17.14 | − | | + | | | | + | | − | | | |
| 3 | 25.71 | | − | | + | | | | + | | − | | |
| 4 | 34.26 | | | − | | + | | | | + | | − | |
| 5 | 42.85 | | | | − | | + | | | | + | | − |
| 6 | 51.43 | + | | | | − | | − | | | | + | |
| 7 | 60.00 | | + | | | | − | | − | | | | + |
| 8 | 68.57 | − | | + | | | | + | | − | | | |
| 9 | 77.14 | | − | | + | | | | + | | − | | |
| 10 | 85.71 | | | − | | + | | | | + | | − | |
| 11 | 94.28 | | | | − | | + | | | | + | | − |
| 12 | 102.85 | + | | | | − | | − | | | | + | |
| 13 | 111.43 | | + | | | | − | | − | | | | + |
| 14 | 120.00 | − | | + | | | | + | | − | | | |
| 15 | 128.57 | | − | | + | | | | + | | − | | |
| 16 | 137.14 | | | − | | + | | | | + | | − | |
| 17 | 145.71 | | | | − | | + | | | | + | | − |
| 18 | 154.28 | + | | | | − | | − | | | | + | |
| 19 | 162.85 | | + | | | | − | | − | | | | + |
| 20 | 171.43 | − | | + | | | | + | | − | | | |
| 21 | 180.00 | | − | | + | | | | + | | − | | |
| 22 | 188.57 | | | − | | + | | | | + | | − | |
| 23 | 197.14 | | | | − | | + | | | | + | | − |
| 24 | 205.71 | + | | | | − | | − | | | | + | |
| 25 | 214.28 | | + | | | | − | | − | | | | + |
| 26 | 222.85 | − | | + | | | | + | | − | | | |
| 27 | 231.43 | | − | | + | | | | + | | − | | |
| 28 | 240.00 | | | − | | + | | | | + | | − | |
| 29 | 248.57 | | | | − | | + | | | | + | | − |
| 30 | 257.14 | + | | | | − | | − | | | | + | |
| 31 | 265.71 | | + | | | | − | | − | | | | + |
| 32 | 274.28 | − | | + | | | | + | | − | | | |
| 33 | 282.85 | | − | | + | | | | + | | − | | |
| 34 | 291.43 | | | − | | + | | | | + | | − | |
| 35 | 300.00 | | | | − | | + | | | | + | | − |
| 36 | 308.57 | + | | | | − | | − | | | | + | |
| 37 | 317.14 | | + | | | | − | | − | | | | + |
| 38 | 325.71 | − | | + | | | | + | | − | | | |
| 39 | 334.28 | | − | | + | | | | + | | − | | |
| 40 | 342.85 | | | − | | + | | | | + | | − | |
| 41 | 351.43 | | | | − | | + | | | | + | | − |
| 42 | 360.00 | + | | | | − | | − | | | | + | |

n = no. of impulses
(1) + = HIGH PRESSURE
w = angle between impulses
(2) − = LOW PRESSURE
NOTE:
Impulses occur only in high pressure region In the above table, $n$ = the impulse number, there being 42 impulses (6×7) per 360° of rotation; $w$ = angle between impulses; "+" designates a high-pressure impulse; and "−" designates a low-pressure impulse.

Figure 8:
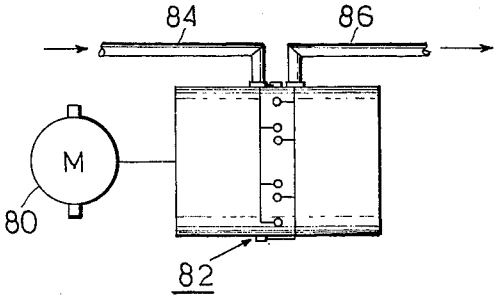
FIG. 8 is a diagramatic view illustrating a pump application of the invention.

The invention has been described above with respect to a preferred embodiment in the form of a hydraulic motor in which the energy from a source of driving fluid is converted into a rotary torque (i.e., the rotation of rotor 32 of the motor). It will be appreciated, however, that features of the invention could advantageously be used in other rotary devices, such as in a hydraulic pump. FIG. 8 illustrates a pump application in which a mechanical drive, e.g., motor 80, drives the rotor of the pump, the pump including a low pressure inlet line 84 and a high-pressure outlet line 86 for removing the resulting pressurized fluid from the chamber between the pistons as they are contracted by the rotation of the rotor. In this case, the high pressure line 24 to the hydraulic distributor 22 would be connected to the high pressure line 86, and the return line of the hydraulic distributor would be connected to line 84 or to the oil tank 20. A further possible application of features of the invention, particularly the arrangement for controlling the coupling bars to couple the pistons to the rotor and stator, would be in a rotary combustion engine.

Many other variations, modifications and applications of the illustrated embodiment will be apparent.

What is claimed is:

1. A rotary device comprising a stator; a rotor mounted coaxially for rotary movement with respect to the stator and defining an annular gap therewith; a plurality of pistons movable within said annular gap in a circumferential direction with respect thereto; each of said pistons including a coupling member movable from a first position coupling the piston to the stator, to a second position coupling the piston to the rotor; and positioning means including a source of pressurized fluid and a fluid distributor including a stationary member fixed to said stator and having a plurality of passageways leading to different locations of the stator at which the coupling members are coupleable to the stator, and a rotary member driven by the rotor to control the flow of the fluid from said pressurized fluid source to said passageways in synchronized timed relationship to the rotation of the rotor such that the coupling members are alternately coupled to the stator and to the rotor to form alternating expansible and contractable chambers between successive pistons.

2. A hydraulic motor including a rotary device in accordance with claim 1, and a source of driving fluid, the rotary device including means for introducing the driving fluid into the chambers to cause them to expand and thereby to rotate the rotor, and means for removing the driving fluid from the chambers during the contraction thereof.

3. A pump including a rotary device in accordance with claim 1, a drive for driving the rotor, means for introducing fluid to be pressurized into the chambers as they expand by the rotation of the rotor, and means for removing the resulting pressurized fluid from the chambers as they are contracted by the rotation of the rotor.

4. A device according to claim 3, wherein each of said pistons is formed with an opening extending in a radial direction therethrough, and each coupling member is slidably disposed within said opening for movement in a radial direction from a first position coupling the piston to the stator to a second position coupling the piston to the rotor.

5. A device according to claim 4, wherein the confronting faces of both the stator and rotor are cylindrical and are formed with axially extending recesses in which the coupling members are seatable for coupling the pistons thereto.

6. A device according to claim 5, wherein said fluid distributor comprises a housing including a plurality of ports leading to the stator recesses of the rotary device, said rotary member of the distributor including: an outer ring formed with a plurality of holes alignable with said ports; an intermediate ring formed with a plurality of channels on its outer face, a plurality of channels on its inner face, and a plurality of holes leading from the inner face channels to the unchanneled portion of the outer face, said holes being alignable with said ports; and an inner ring closing the inner-face channels of the intermediate ring.

7. A device according to claim 5, wherein there are a plurality of $n$ pistons, the number of recesses in the stator being equal to $n+1/2$.

8. A device according to claim 7, wherein the number of recesses in the rotor is equal to $n+1/2$ times $n+3/2$.

* * * * *